US008122663B1

(12) United States Patent
Hohmann, Jr. et al.

(10) Patent No.: US 8,122,663 B1
(45) **Date of Patent: *Feb. 28, 2012**

(54) ANCHORS AND REINFORCEMENTS FOR MASONRY WALLS

(75) Inventors: Ronald P. Hohmann, Jr., Hauppauge, NY (US); Ronald P. Hohmann, Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 274 days.

This patent is subject to a terminal disclaimer.

(21) Appl. No.: 12/150,666

(22) Filed: Apr. 29, 2008

Related U.S. Application Data

(63) Continuation-in-part of application No. 10/938,331, filed on Sep. 10, 2004, now abandoned.

(51) Int. Cl.
*E04B 1/16* (2006.01)

(52) U.S. Cl. ..... 52/379; 52/513; 52/713

(58) Field of Classification Search ..... 52/513, 52/562, 565, 713, 379, 383
See application file for complete search history.

(56) References Cited

U.S. PATENT DOCUMENTS 3,134,169 A * 5/1964 Hollander et al. ..... 228/114.5
3,277,626 A 10/1966 Brynjolfsson et al.
3,300,939 A * 1/1967 Brynjolfsson et al. ..... 52/713
3,309,828 A 3/1967 Tribble
3,341,998 A 9/1967 Lucas
3,377,764 A 4/1968 Storch
3,494,090 A 2/1970 Allen
3,964,226 A * 6/1976 Hala et al. ..... 52/562
4,021,990 A 5/1977 Schwalberg
4,031,685 A * 6/1977 Heinz ..... 52/649.4
4,240,233 A 12/1980 Vercelletto
4,373,314 A 2/1983 Allan
4,473,984 A 10/1984 Lopez
4,660,342 A 4/1987 Salisbury
4,819,401 A 4/1989 Whitney, Jr.
4,852,320 A 8/1989 Ballantyne
4,869,038 A 9/1989 Catani
4,875,319 A 10/1989 Hohmann
4,946,632 A 8/1990 Pollina
4,955,172 A 9/1990 Pierson
4,970,842 A * 11/1990 Kappeler et al. ..... 52/74
5,207,043 A 5/1993 McGee et al.
5,230,136 A * 7/1993 Cronn et al. ..... 29/521

(Continued)

OTHER PUBLICATIONS

Building Envelope Requirements, 780 CMR 1304.0 et seq. of Chapter 13; Boston, MA, Jan. 1, 2001.

(Continued)

*Primary Examiner* — Brian Glessner
*Assistant Examiner* — Christine T Cajilig
(74) *Attorney, Agent, or Firm* — Siegmar Silber, Esq.

(57) ABSTRACT

Anchor and reinforcement devices for a cavity wall are disclosed. The devices are combined with interlocking veneer anchors, and with veneer reinforcements to form unique anchoring systems. All the components of the system are wire formatives, including therewithin truss or ladder reinforcements and the eye extensions. The wall anchor portion of the device is fusibly attached to the exterior of the truss or ladder reinforcement by various metalworking techniques. Beyond the portions of the wire formatives inserted in the backup wall, the wire formatives are optionally reduced in height by cold-working thereof. The combined wall anchor and reinforcement devices are compressively reduced in height for spanning insulation mounted on the exterior of the backup wall. The low-profile portions are disposed between thick strips of insulation and maintain the insulative integrity thereof by preventing air leakage.

19 Claims, 7 Drawing Sheets

U.S. PATENT DOCUMENTS

| | | | | |
|---|---|---|---|---|
| 5,392,581 | A | 2/1995 | Hatzinikolas et al. | |
| 5,408,798 | A | 4/1995 | Hohmann | |
| 5,454,200 | A | 10/1995 | Hohmann | |
| 5,456,052 | A | 10/1995 | Anderson et al. | |
| 5,634,310 | A * | 6/1997 | Hohmann | 52/513 |
| 5,816,008 | A | 10/1998 | Hohmann | |
| 5,845,455 | A | 12/1998 | Johnson, III | |
| 5,915,745 | A | 6/1999 | Looverie et al. | |
| 6,199,344 | B1 | 3/2001 | Looverie et al. | |
| 6,209,281 | B1 | 4/2001 | Rice | |
| 6,279,283 | B1 * | 8/2001 | Hohmann et al. | 52/379 |
| 6,460,824 | B1 | 10/2002 | Lancelot, III et al. | |
| 6,553,737 | B1 * | 4/2003 | Berg | 52/687 |
| 6,668,505 | B1 | 12/2003 | Hohmann et al. | |
| 6,735,915 | B1 * | 5/2004 | Johnson, III | 52/379 |
| 6,789,365 | B1 | 9/2004 | Hohmann et al. | |
| 2003/0233804 | A1 * | 12/2003 | Getz et al. | 52/698 |
| 2004/0083667 | A1 * | 5/2004 | Johnson, III | 52/379 |
| 2004/0245878 | A1 * | 12/2004 | Kim et al. | 310/114 |
| 2006/0242921 | A1 * | 11/2006 | Massie | 52/309.4 |

OTHER PUBLICATIONS

ASTM Committee A01, Standard Specifications for Masonry Joint Reinforcement; Designation A951-00 (Approved Sep. 10, 2000; Published Oct. 2000).

Cantini, Mario J.; Heavy Duty Joint Reinforcement, Masonry, Apr. 1995.

Lochonic, K. et al; Wall Reinforcing Design, The Story Pole, Aug. 2001.

DUR-O-WAL, Inc.; Product Catalog (Aurora, IL, 2000).

Wire Bond Corp.; Product Catalog (Charlotte, NC, 2002/2003).

Hohmann & Barnard, Inc.; Product Catalog (Hauppauge, NY; 2002).

DUR-O-WAL Product Information Sheet—Tech Paper 93-1, (Aurora, IL, undated).

Fero Holdings Ltd.; Product Catalog and data sheets (Edmont, Alberta, Canada, undated).

* cited by examiner

ANCHORS AND REINFORCEMENTS FOR MASONRY WALLS

RELATED APPLICATIONS

This application is a continuation-in-part of an Application entitled Anchors and Reinforcements for Masonry Walls, Ser. No. 10/938,331, filed Sep. 10, 2004, now abandoned which Application is incorporated herein by reference.

BACKGROUND OF THE INVENTION

1. Field of the Invention

This invention relates to reinforcement and anchor assemblies and more particularly to reinforcement and anchor assemblies that are mechanically joined through extremely high pressure. In this manner, the mechanical jointure of the metal occurs when the resulting heat from the compression pressure causes the metal to liquify and fuse. The reinforcement and anchor assemblies described are for use in masonry backup walls and, in particular, cavity wall constructs requiring superior anchoring properties and low-profile anchor configurations.

2. Description of the Prior Art

In recent developments of low-profile and high-span anchoring devices, several metalworking techniques that had not previously been utilized, were employed with significant and gratifying results. Some of these developments arose in response to shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, wall anchors are needed to occupy the same ⅜-inch-high space in the inner wythe and tie down a veneer facing material of an outer wythe at a span of two or more times that which had previously been experienced. In essence, while the height of the bed joints in both the inner and outer wythes are fixed by trade standards, as wall cavity spans increase because of added insulation, stronger reinforcement is required. The end result needs to incorporate wire formatives of the thickest gauge, adequate mortar coverage of the insertion end of the wall anchors and the veneer anchors, and secure metal joining between the wall anchors and the reinforcing truss or ladder structures. The invention described herein accomplishes these ends in a novel and unobvious manner.

Exemplary of the public sector building specification is that of the Energy Code Requirement, Boston, Mass. (see Chapter 13 of 780 CMR, Seventh Edition). This Code sets forth insulation R-values well in excess of prior editions and evokes an engineering response opting for thicker insulation and correspondingly larger cavities. Here, the emphasis is upon creating a building envelope that is designed and constructed with a continuous air barrier to control air leakage into or out of conditioned space adjacent the inner wythe.

Another application for high-span anchoring systems is in the evolving technology of self-cooling buildings. Here, the cavity wall serves additionally as a plenum for delivering air from one area to another. While this technology has not seen wide application in the United States, the ability to size cavities to match air moving requirements for naturally ventilated buildings enables the architectural engineer to now consider cavity walls when designing structures in this environmentally favorable form.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gauge wire formatives which result in easier alignment of courses of block.

In the past, there have been investigations relating to the effects of various forces, particularly lateral forces, upon brick veneer construction having wire formative anchors embedded in the mortar joint of anchored veneer walls. The seismic aspect of these investigations were referenced in the first-named inventor's prior patents, namely, U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions. The first-named inventor's related Seismiclip® and DW-10-X® products (manufactured by Hohmann & Barnard, Inc., Hauppauge, N.Y. 11788) have become widely accepted in the industry. The use of a wire formative anchors and reinforcement wire structures in masonry walls has been shown to protective against problems arising from thermal expansion and contraction. Also, such structures have improved the uniformity of the distribution of lateral forces. However, these past investigations do not address the mortar layer thickness vs. the wire diameter of the wire formative or the technical problems arising therefrom.

Over time and as the industry matured, besides the Uniform Building Code other standards came into existence, including the promulgation by the ASTM Committee A01 on Steel of the Standard Specifications for Masonry Joint Reinforcement, A951-00 (hereinafter A951). The Standard sets forth that masonry joint reinforcement is to be assembled by automatic machines to assure accurate spacing and alignment of all members of the finished product and that longitudinal and cross wires are to be securely connected at every intersection by an electric-resistance welding process that includes fusion welding together with applied pressure to join the materials. The Standard further sets forth details as to the exterior of the longitudinal wires and the mechanical requirements of the overall construct.

According to the ASTM Committee A01, joint reinforcement has been used in the masonry industry since 1940. In introducing A951, the Committee states:

> For most of the period since then, its manufacture has been limited to a relatively small group of producers and users who simply referred to "manufacturers' recommendations" as the standard of quality and acceptance. With the adoption of a new consensus standard for the design of masonry, it became clear that a standard for the manufacture of joint reinforcement was needed. In developing this standard it was decided to use a format similar to that used for the ASTM Standard for Welded Wire Fabric, Plain, for Concrete Reinforcement, Specification A185, since many people had the notion that joint reinforcement was used in a manner similar to wire mesh. A significant difference between wire mesh and joint reinforcement arose when an attempt was made to fashion the requirements for weld shear strength after those in Specification A185.

The Committee found that almost all of the manufacturers of joint reinforcement use butt welds so that the total thickness of material at a weld is as small as possible. This is important since, in conventional mortar bed joints, there is not much room to install joint reinforcement. In addition, it found that in masonry joint reinforcement the majority of product produced is that with a "truss" configuration in which the angle of intersection varies for each different width of product produced since the pitch between welds is a constant 16 inches. These characteristics differentiated the testing for weld shear strength from those of Specification A185 and resulted in the development of a distinct test methodology.

In addition to addressing the thickness and strength of the reinforcement, the costs and safety related to the manufacturing of the product are also considered. The invention herein addresses the need for a safe and efficient manner of production, by utilizing a novel method of attachment that does not require the welding that is taught by the prior art. Further, the present invention implements a manufacturing process that saves on the costs of production and material beyond those previously disclosed.

The present invention employs a method of production that utilizes a wire formative of the same gauge for both the intermediate rod and the eye wire extensions. Such wire formatives are cut into the required lengths and the eye wire extensions are configured to accept a veneer anchor. The wire formative is either a single unit that serves as the intermediate rod and the eye wire extension or separate units. By using a single size wire formative for each component, and forming the veneer anchor receptor from such wire formative, production of both the intermediate rod and eye wire extension can be performed concurrently, saving both time and resources.

Once the wire formatives are cut, they are joined at the predetermined locations against the side rods using a method of high pressure mechanical fusion that causes a sufficient quantity of heat and pressure, so that the top layer of the joining metals flow until fused. The energy from the high pressure impact plasticizes the materials and forms a fused connection. High pressure fusion creates a joint similar to a lap joint, which is favored over the previously disclosed butt weld due to the low tensile strength of a butt weld solder. Such fused method produces a reinforcement and anchor assembly that is safer and more economical to produce.

In the course of preparing this disclosure several patents became known to the inventors hereof. The following patents and patent applications are believed to be relevant and are discussed further as to the significance thereof:

| patent | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 02, 1984 |
| 4,869,038 | Catani | Sep. 26, 1989 |
| 4,875,319 | Hohmann | Oct. 24, 1989 |
| 5,230,136 | Cronn et al. | Jul. 27, 1993 |
| 5,392,581 | Hatzinikolas et al. | Feb. 28, 1995 |
| 5,408,798 | Hohmann | Apr. 25, 1995 |
| 5,456,052 | Anderson et al. | Oct. 10, 1995 |
| 5,816,008 | Hohmann | Oct. 15, 1998 |
| 6,209,281 | Rice | Apr. 03, 2001 |
| 6,279,283 | Hohmann et al. | Aug. 28, 2001 |
| 10/179,432 | Getz et al. | Dec. 25, 2003 |

It is noted that with some exceptions the following devices are generally descriptive of wire-to-wire anchors and wall ties and have various cooperative functional relationships with straight wire runs embedded in the inner and/or outer wythe.

U.S. Pat. No. 3,377,764—D. Storch—Issued Apr. 16, 1968
Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977
Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983
Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984
Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued 091/26/89
Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989
Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,392,581—Hatzinikolas et al.—Issued Feb. 28, 1995
Discloses a cavity-wall anchor having a conventional tie wire for embedment in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995
Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer.

U.S. Pat. No. 5,456,052—Anderson et al.—Issued Oct. 10, 1995
Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998
Discloses a brick veneer anchor primarily for use with a cavity wall with a drywall inner wythe. The device combines an L-shaped plate for mounting on the metal stud of the drywall and extending into the cavity with a T-head bent stay.

After interengagement with the L-shaped plate the free end of the bent stay is embedded in the corresponding bed joint of the veneer.

U.S. Pat. No. 6,209,281—Rice—Issued Apr. 3, 2001

Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2001

Discloses a low-profile wall tie primarily for use in renovation construction where in order to match existing mortar height in the facing wythe a compressed wall tie is embedded in the bed joint of the brick veneer.

US 2003/0233804 A1—Getz et al.—Pub. Date Dec. 25, 2003

Discloses a joint reinforcement, for use in a masonry wall unit, with eye sections and cross rods concurrently manufactured and butt welded to the joint reinforcement side rods. The method of manufacture removes secondary assembly of the eye sections.

The present invention provides a novel method of production using high pressure and the resultant energy to liquify and fuse the wire formatives. This novel approach removes the environmental effects of welding and the safety concerns and high costs associated therewith.

Other alternatives to welding have been developed in related areas, such as methods for joining sheet metal using punch and die sets. An example of this method of attachment is detailed in U.S. Pat. No. 5,230,136—Cronn et al.—Issued Jul. 27, 1993. In Cronn, a die is disclosed to join sheet metals with thicknesses of about 0.02 and 0.05 inches. Cronn employs a clinching process by which sheet metals are joined through interlocking. The clinching process utilizes metal deformation and specifically avoids fusion to interlock the sheet metals. While this method of attachment is useful for sheet metal, it is not practical for joining wire formatives for anchors and reinforcements where a permanent meld is required. As discussed previously, there is limited space in the mortar joint. Employing Cronn's method would cause an interlock that increases the height of the wire formative. Such increase would potentially result in an anchor and reinforcement that exceeds the maximum allowable mortar joint height, or require the use of flimsy wire formatives that would jeopardize the integrity of the wall reinforcement. The present method of attachment joins the wire formatives in a manner which allows for proper placement and reinforcement of a cavity wall structure.

None of the above prior art provides either separately or when taken in combination the fused wall anchor and wall reinforcement devices hereof or the anchoring systems utilizing these devices. As will become clear in reviewing the disclosure which follows, the masonry backup walls benefit from the recent developments described above that led first to solving the problems of high-spans and of providing high strength anchoring within the profile limitations. In the related Application, wire formatives are compressively reduced in height at the junctures between the wall reinforcements and the wall anchors. This enabled the stacked components to be inserted within the bed joints and still have a covering of mortar. While this approach worked well, alternatives utilizing techniques such as fusing under heat and pressure are presented hereinbelow.

SUMMARY

In general terms, the invention disclosed hereby includes fused anchor and reinforcement devices for a cavity wall, which devices are combined with interlocking veneer anchors, and in one embodiment hereof with veneer reinforcements. The wall construct has an inner wythe or backup wall and an outer wythe or facing wall. The wythes are in a spaced apart relationship and have a cavity therebetween. In the embodiments disclosed, a unique combination of a wall anchor, a reinforcement and a veneer anchor, is provided. The invention contemplates that the primary components of the system using a single method of production and are structured from reinforcing wire and wire formatives, including as part of the combined device, truss reinforcement or ladder mesh reinforcements as well as eye wire extensions, and provides wire-to-wire connections therebetween. Further, two embodiments combine wire formatives which are selectively and compressively reduced in height by the cold-working thereof.

The embodiments of the invention disclosed hereby include anchoring systems with mechanically fused wall anchors and low-profile veneer anchors for use in the construction of a wall having high-span cavities because of code required insulation. Where as in the first embodiment, there is compressive reduction in height of the insulation-spanning leg portions, the air leakage at and adjacent heavy wire components is substantially overcome. This results as the strips of insulation are installed so that the seams between the strips are coplanar with the inner wythe bed joints. The insulation-spanning legs of the wall anchors protrude into the cavity through the seams, which seams seal thereabout so as to maintain the integrity of the insulation and minimize air leakage along the wall anchors. The invention contemplates that some components of the system are as described in U.S. Pat. Nos. 5,408,798; 5,454,200; and 6,279,283 in that the wire formatives hereof provide a positive interlocking connection therebetween specific for the requirements created by this mechanically fused anchor and anchoring system application.

In the mode of practicing the invention, wherein the inner wythe is constructed from a masonry block material, the masonry anchor has, for example, a truss portion with eye wire extensions mechanically joined thereto. The eye wires extend across the insulation into the cavity between the wythes. Each of the eye wires accommodates the threading thereinto of a wire facing anchor or wall tie with either a pintle leg inserted through the eye or the open end of the wall tie. The wall tie is then positioned so that the insertion end is embedded in the facing wall. The masonry anchor is embedded in a bed joint of the interior wythe. Wall and veneer ties compressively reduced in height are described as being mounted in bed joints of the inner and outer wythes. The close control of overall heights permits the mortar of the bed joints to flow over and about the wall reinforcement and wall anchor combination inserted in the inner wythe and insertion end of the veneer anchor in the outer wythe.

OBJECTS AND FEATURES OF THE INVENTION

It is an object of the present invention to provide for cavity walls, anchoring systems, anchors for the masonry backup walls, and anchors for the securement of facing veneers.

It is another object of the present invention to provide labor-saving anchoring systems which employ mechanically fused wire formatives in the mortar joint of the inner wythe and is adapted to be positively interconnected with a veneer anchor inserted into the outer wythe.

It is yet another object of the present invention to provide a high-strength, anchoring systems for both insulated and uninsulated cavity wall structures which utilize high cross-sectional area components for wall reinforcement of the inner wythe in a manner such that the mortar layer coverage thereof is maintainable.

It is a further object of the present invention to provide an anchoring system comprising a limited number of component parts that are economical of manufacture resulting in a low unit cost.

It is another object of the present invention that employing a wire formative of equal gauge, for the intermediate rod and eye wire extensions, results in cost savings.

It is yet another object of the present invention to provide an anchoring system which is easy to install and which meets seismic and shear resistance requirements.

It is a feature of the present invention that the portion of the wall anchor embedded in the bed joint of the inner wythe is fused through high pressure fusion thereof to the wire reinforcement portion.

It is another feature of the present invention that the veneer anchor, the wall tie and the combined wall anchor and wall reinforcement are dimensioned so that, when inserted into the respective mortar layers, the mortar thereof can flow around the wall-anchor-to-reinforcement-wire joint.

It is a yet another feature of the present invention that the wire formatives used for production of the intermediate rod and eye wire extensions have the same gauge.

It is a further feature of the present invention that the eye wire extensions are formed from the wall anchor to accept a veneer anchor.

It is yet another feature of the present invention that the reinforcement wire of the inner wythe is combinable with a low-profile wall anchor to span the insulation of the cavity wall at the seam thereof and that the wall anchor is sealingly surrounded by the insulation.

Other objects and features of the invention will become apparent upon review of the drawing and the detailed description which follows.

BRIEF DESCRIPTION OF THE DRAWINGS

In the following drawings, the same parts in the various views are afforded the same reference designators.

DESCRIPTION OF THE PREFERRED EMBODIMENTS

Figure 1:
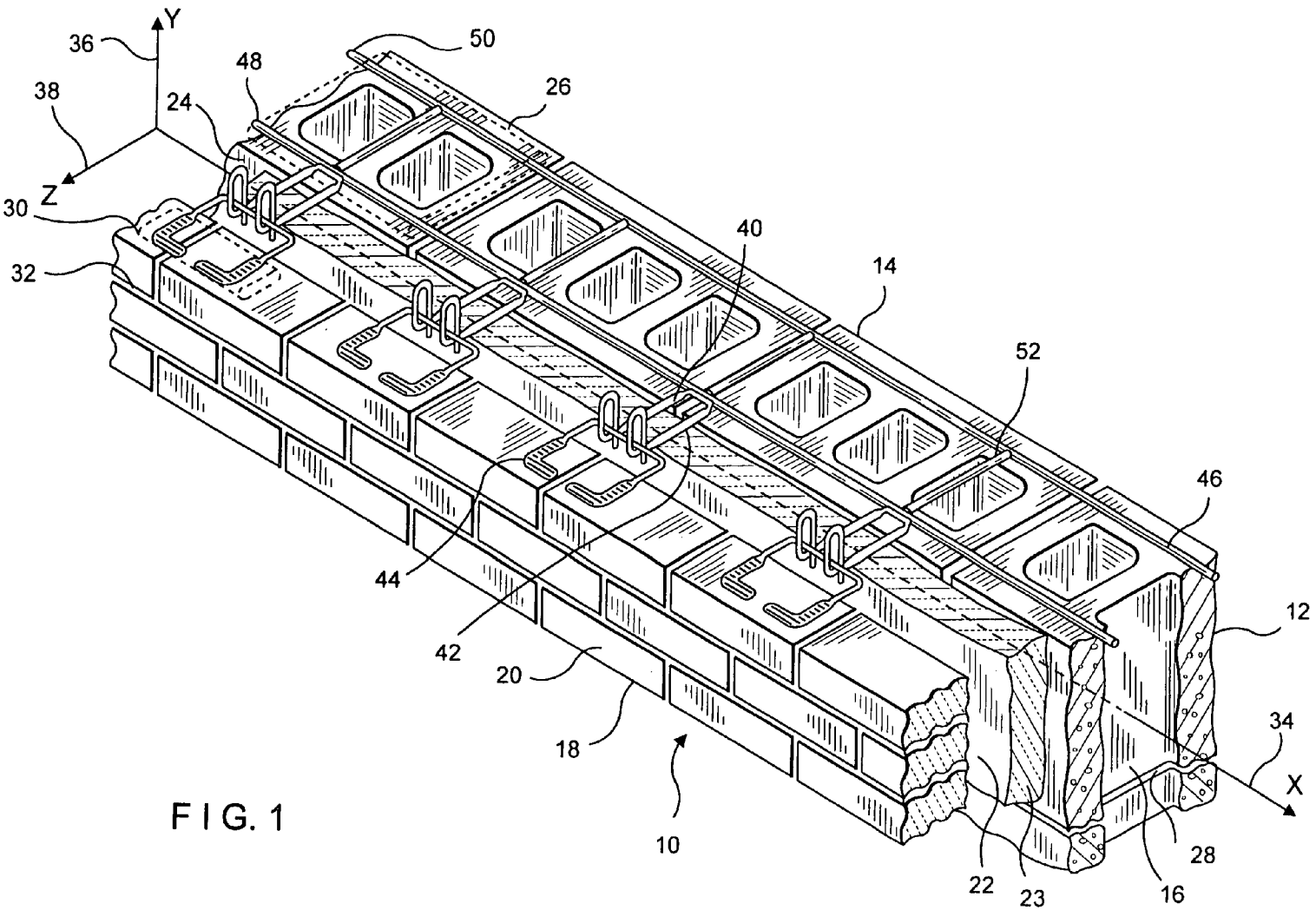
FIG. 1 is a perspective view of a first embodiment of this invention showing a side-fused anchor and reinforcement device for a cavity wall, a cavity with insulation mounted as the backup wall, and a brick veneer facing.

Before entering into the detailed Description of the Preferred Embodiments, several terms are defined, which terms will be revisited later, when some relevant analytical issues are discussed. When stronger joint reinforcements are required in the inner wythe or backup wall to support the stresses imparted by anchoring the outer wythe or veneer. As described hereinbelow, this is accomplished while still maintaining building code requirements for masonry structures, including the mortar bed joint height specification—most commonly 0.375 inches. Although thicker gauge wire formatives are used when required for greater strength, it is still desirable to have the bed joint mortar cover the wall anchor structure. Thus, the wall reinforcements are usually structured from 0.148 or 0.187 inch wire, and, in practical terms, the wire formatives hereof that are inserted into the bed joints of the inner and outer wythes have a height limited to approximately 0.187 inch.

In the detailed description, the wall reinforcements, the wall anchors, and the veneer anchors are wire formatives. The wire used in the fabrication of masonry joint reinforcement conforms to the requirements of ASTM Standard Specification A951-00, Table 1. For the purpose of this application weld shear strength tests, tensile strength tests and yield tests of masonry joint reinforcements are, where applicable, those denominated in ASTM A-951-00 Standard Specification for Masonry Joint Reinforcement. In the descriptions of wall anchors which follow, the wall anchors are fusibly attached to the ladder-type or the truss-type reinforcements. As the attachment methodology follows that of fabricating the Masonry Joint Reinforcements, the tests for the wall anchors, except where fixturing is dictated by configuration, follow the A-951 procedures.

In the detailed description of the anchoring systems hereof the various wall anchor embodiments have elements which receive interlocking or interengaging portions of the veneer anchor. These veneer anchor receptors are wire-formatives, such as double loops vertically disposed in the cavity for receiving box ties; eye wires—round eyelets horizontally disposed in the cavity for receiving pintle legs; and T-head openings—horizontally disposed in the cavity for receiving pintle legs or bent box ties. The veneer anchors, when extra reinforcement is desired, are configured to cradle, nest or interweave with wire reinforcements, which reinforcements are embedded in the bed joints of the veneer. The veneer reinforcements meet seismic specifications.

Another term defined for purposes of this application is wall reinforcement. A wall reinforcement is a continuous length of Lox All™ Truss Mesh or Lox All™ Ladder Mesh manufactured by Hohmann & Barnard, Inc., Hauppauge, N.Y. 11788 or equivalent adapted for embedment into the horizontal mortar joints of masonry walls. The wall reinforcements are prefabricated from cold-drawn steel wire and have parallel side rods with fused cross rods or truss components. The wall reinforcements for anchoring systems are generally structured from wire that is at least 0.148 and 0.187 inch in diameter.

Referring now to FIGS. 1 through 4, the first embodiment of a side-fused anchor and reinforcement for masonry backup wall is now discussed in detail. For the first embodiment, a cavity wall having an insulative layer of 1.5 inches (approx.) and a total span of 3 inches (approx.) is chosen as exemplary. The side-fused anchor and reinforcement device for masonry walls is referred to generally by the numeral 10. A cavity wall structure 12 is shown having an inner wythe or backup wall 14 of masonry blocks 16 and an outer wythe or facing wall 18 of brick 20. Between the inner wythe 14 and the outer wythe 18, a cavity 22 is formed.

The cavity 22 is insulated with strips of insulation 23 attached to the exterior surface 24 of the inner wythe 14 and having seams 25 between adjacent strips 23 coplanar with adjacent bed joints 26 and 28. The cavity 22 has a 3-inch span. Successive bed joints 26 and 28 are formed between courses of blocks 16. The bed joints 26 and 28 are substantially planar and horizontally disposed and in accord with building standards are 0.375-inch (approx.) in height. Also, successive bed joints 30 and 32 are formed between courses of bricks 20 and the joints are substantially planar and horizontally disposed. Selected bed joint 26 and bed joint 30 are constructed to be interconnected utilizing the construct hereof; however, in this embodiment, the joints 26 and 30 are unaligned.

For purposes of discussion, the cavity surface 24 of the inner wythe 14 contains a horizontal line or x-axis 34 and an intersecting vertical line or y-axis 36. A horizontal line or z-axis 38, normal to the xy-plane, passes through the coordinate origin formed by the intersecting x- and y-axes. A wall anchor 40 is shown which has an insulation-spanning portion 42. Wall anchor 40 is a wire formative tie which is constructed for embedment in bed joint 26 and for interconnection with veneer tie 44.

The wall anchor 40 is adapted from one shown and described in Hohmann, U.S. Pat. No. 5,454,200, which patent is incorporated herein by reference. The wall anchor 40 is shown in FIG. 1 as being emplaced on a course of blocks 16 in preparation for embedment in the mortar of bed joint 26. In this embodiment, the system includes a ladder-type wall reinforcement 46, a wall anchor 40 and a veneer anchor 44. The wall reinforcement 46 is constructed of a wire formative with two parallel continuous straight, side wires 48 and 50 spaced so as, upon installation, to each be centered along the outer walls of the masonry blocks 16. An intermediate wire body or a plurality of cross rods 52 are interposed therebetween and connect wire members 48 and 50 forming rung-like portions of the ladder-type reinforcement 46. The horizontal xz-plane tangential to the upper limit of wires 48 and 50, the parallel xz-plane tangential to the lower limit, and the vertical xy-plane that includes surface 24 form an envelope within which the attachment end of wall anchor 40 is disposed.

At intervals along the ladder-type reinforcement 46, spaced pairs of transverse wire members 54 are attached thereto and are attached to each other by a rear leg 56 therebetween. These pairs of wire members 54 extend into the cavity 22. The spacing therebetween limits the x-axis movement of the construct. Each transverse wire member 54 has at the end opposite the attachment end, an eye wire portion 58 formed continuous therewith. Upon installation, the eye 60 of eye wire portion 58 is constructed to be within a substantially vertical plane normal to exterior surface 24. The eye 60 is elongated vertically to accept a veneer tie threadedly therethrough from the unaligned bed joint. The eye 60 is slightly larger horizontally than the diameter of the tie. This dimensional relationship minimizes the z-axis movement of the construct. For positive interengagement, the eye 60 of eye wire portion 58 is sealed forming a closed loop.

Figure 2:
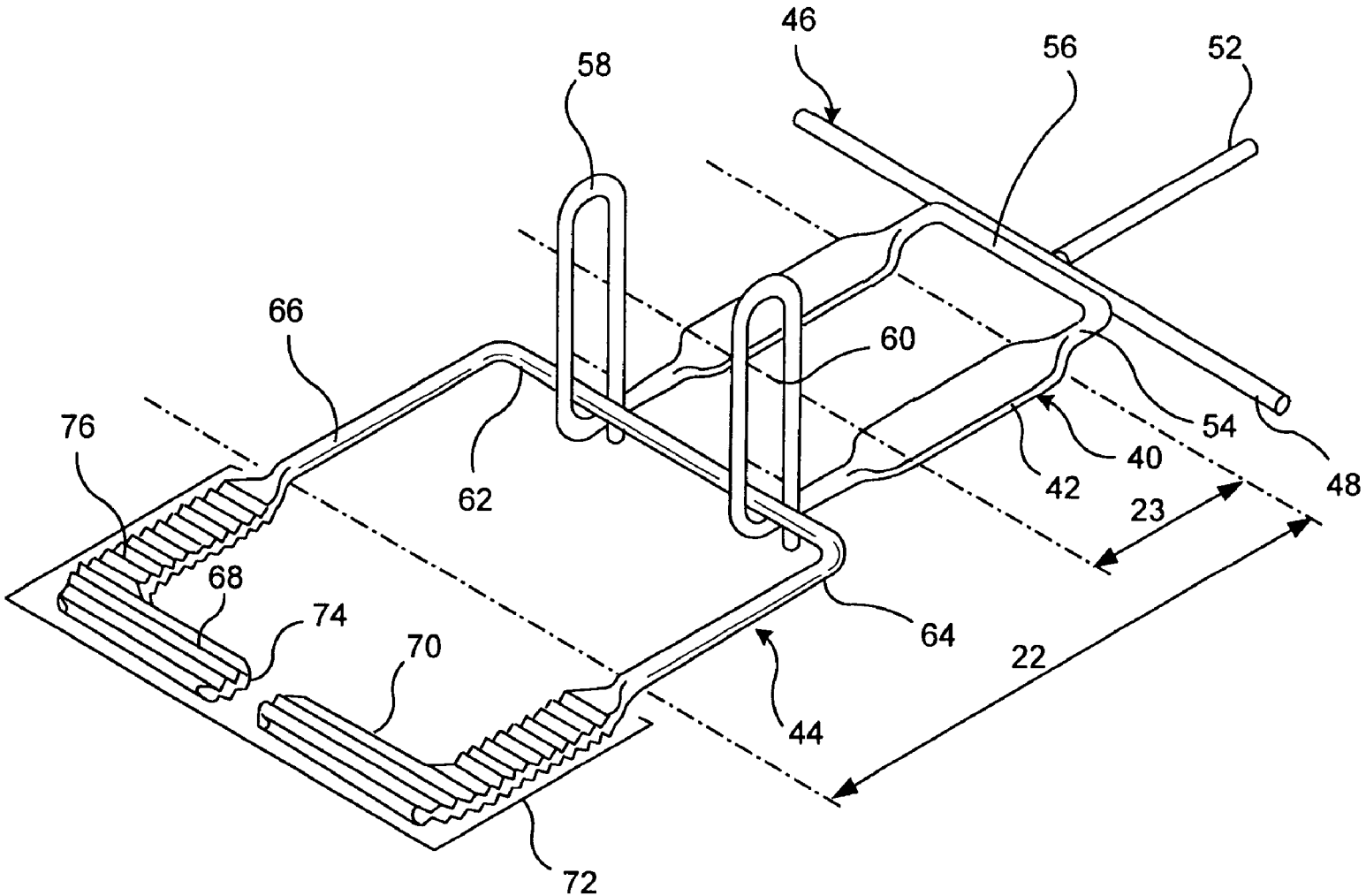
FIG. 2 is a partial perspective view of FIG. 1 showing a portion of the wall reinforcement; the resistance-fused, wall anchor; and, the interlocking veneer anchor.

The veneer tie or anchor 44, FIG. 2, is, when viewed from a top or bottom elevation, generally rectangular in shape and is a basically planar body. The veneer anchor 44 is dimensioned to be accommodated by a pair of eye wire portions 58 described, supra. The veneer anchor 44 has a rear leg portion 62, two parallel side leg portions 64 and 66, which are contiguous and attached to the rear leg portion 62 at one end thereof, and two parallel front leg portions 68 and 70.

To facilitate installation, the front leg portions 68 and 70 are spaced apart at least by the diameter of the eye wire member 58. The longitudinal axes of leg portions 66 and 68 and the longitudinal axes of the contiguous portions of the side leg portions 64 and 66 are substantially coplanar. The side leg portions 64 are structured to function cooperatively with the spacing of transverse wire members 54 to limit the x-axis movement of the construct. The box-shaped veneer anchor 44 and the double loops of the wall anchor 40 are constructed so that with insertion of the veneer anchor through eye 60, the misalignment between bed joints tolerated is approximately one-half the vertical spacing between adjacent bed joints of the facing brick course. As will be described in more detail hereinbelow, the insertion portion 72 of veneer tie 44 is considerably compressed with the vertical height 74 being reduced. Upon compression, a pattern or corrugation 76 is impressed.

For specific applications, the above-described arrangement of wire formatives has been strengthened in several ways. First, in place of the standard 9-gauge (0.148-inch diameter) wall reinforcement wire, a 3/16-inch (0.187-inch diameter) wire is used. Additionally a 0.187-inch wire is used to form both the wall anchor 40 and the veneer anchor 44. For added strength, it is optional to employ 0.250-inch cross rods compressively reduced in height to fit within the envelope, see supra, and also U.S. Pat. No. 6,279,283 to Hohmann, et al. The insertion end of veneer anchor 44 is also compressively reduced in height and, although 0.187 wire is used, optionally a 0.250 wire reduced to a height of 0.150 is within the contemplation hereof. Additionally, extended leg 42 for spanning insulation 23 is reduced in height to improve sealing. Thus, the components hereof are selectively compressible, and, as a general rule, compressive reductions up to 75% are utilized. The tensile and shear strength calculations are based thereon.

In this embodiment, the rear leg portion 56 is secured to wire member 48 of ladder-type wall reinforcement 46 by resistance fusing forming a butt weld. At the butt weld site, the metal bodies of the two members 56 and 48 are fused together which fusion is shown in the cutaway portion of FIG. 3. In order to fall within the height requirement, the insertion portion of the wall anchor 40, that is the portion thereof which is within the mortar of the bed joint lies wholly in the envelope formed by the parallel planes of the upper and lower surfaces of the installed wall reinforcement 46 and the vertical plane of exterior surface 24.

Figure 3:
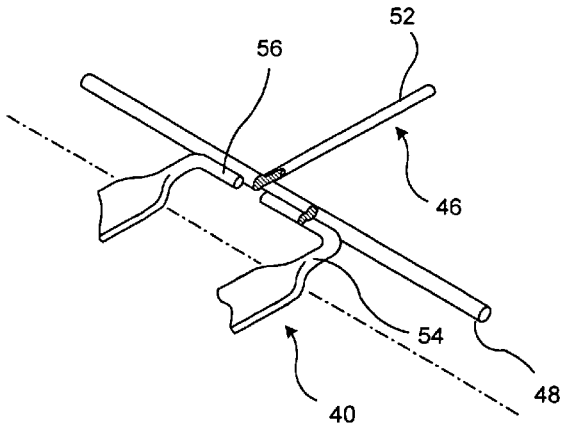
FIG. 3 is a partial perspective view of FIG. 2 which is cutaway to show the fusion of the back leg of the wall anchor and the masonry wall reinforcement at the fused site.

As described in a prior patent of the present inventors, namely, Hohmann et al., U.S. Pat. No. 6,279,283, the insertion ends of the wall anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 1 and 2 and are impressed so that, upon installation, the corrugations are parallel to the x-axis. In FIG. 3, the lower surface of wall reinforcement 46 is shown having corrugations 80 impressed therein.

Figure 4:
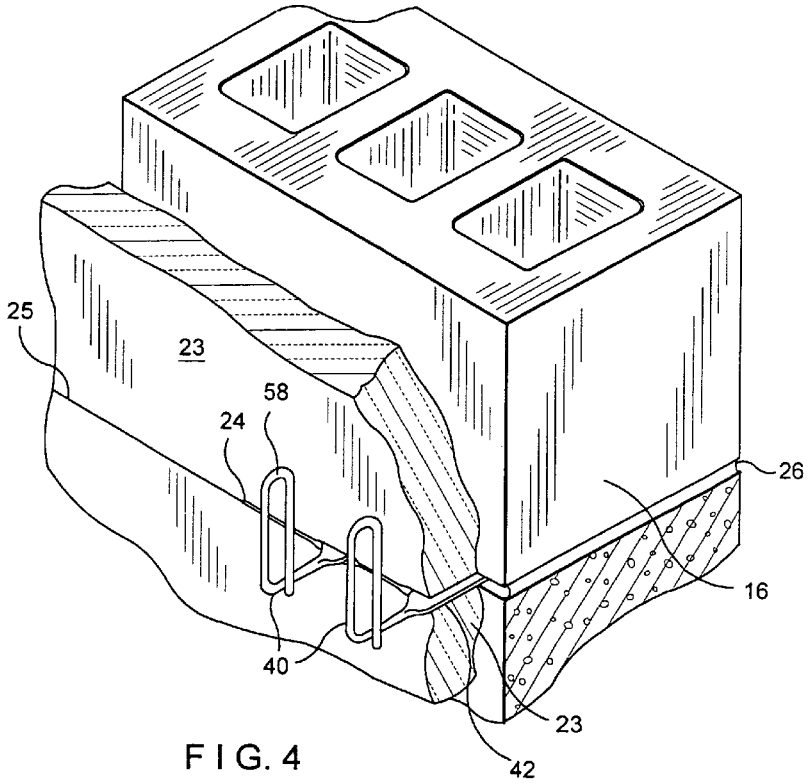
FIG. 4 is a partial perspective view of the insulation sealing about and against the insulation-spanning portion of the wall anchor of FIG. 2.

The wall cavity is insulated as required with a high R-factor insulation layer 23 as shown in FIG. 4. The successive insulation strips 23 when in an abutting relationship the one with the other are sufficiently resilient to seal at seam 25 without air leakage therebetween. The insulation-spanning portions 42 of wall anchor 40 are flattened. This results in minimal interference with seal at seam 25.

Figure 5:
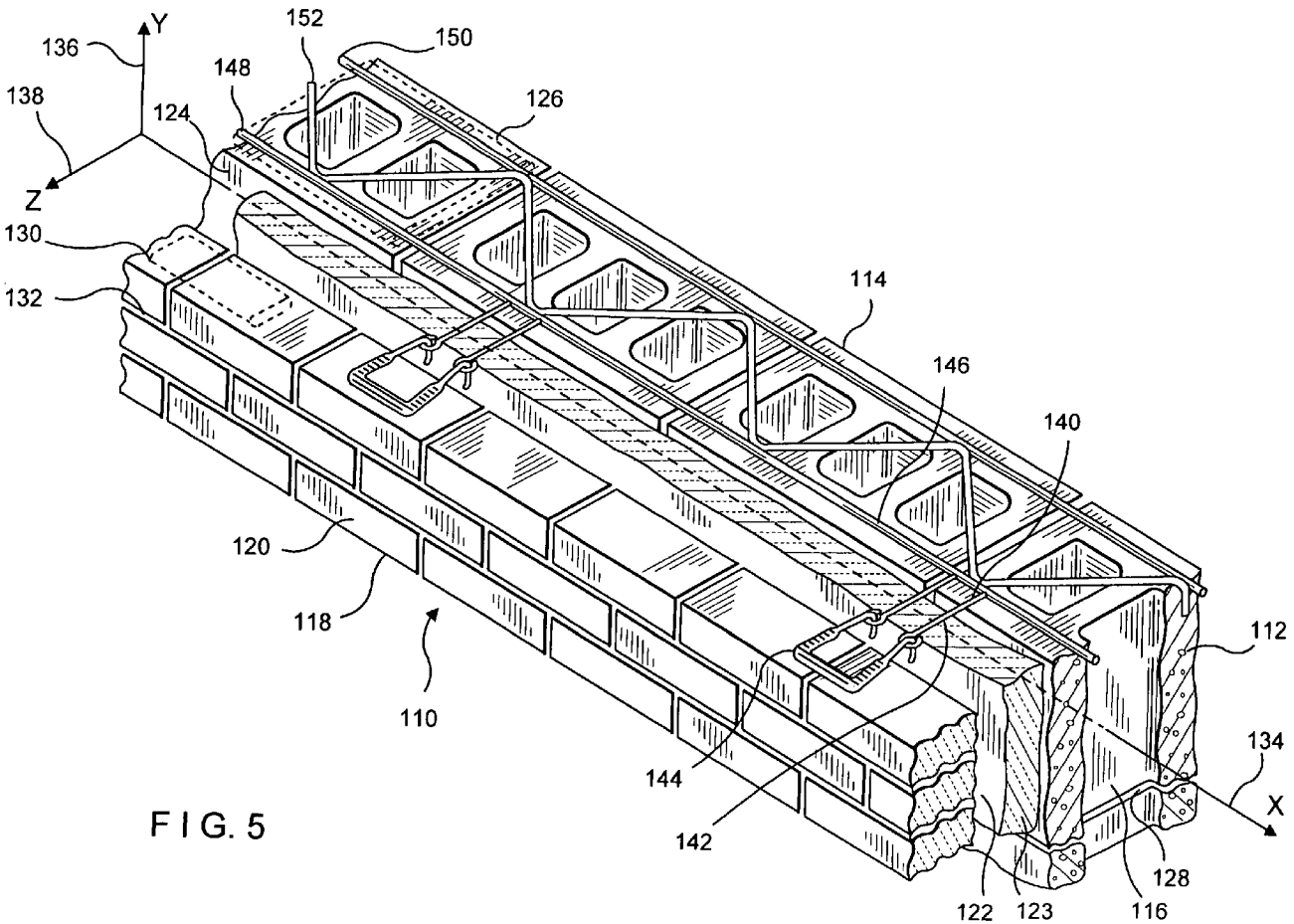
FIG. 5 is a perspective view of a second embodiment of this invention showing an anchor and reinforcement device for a masonry wall and is similar to FIG. 1, but shows a truss-mesh reinforcement in the backup wall, a wall anchor with horizontal eyelets, and a rectangular pintle veneer anchor in the facing wall.
Figure 6:
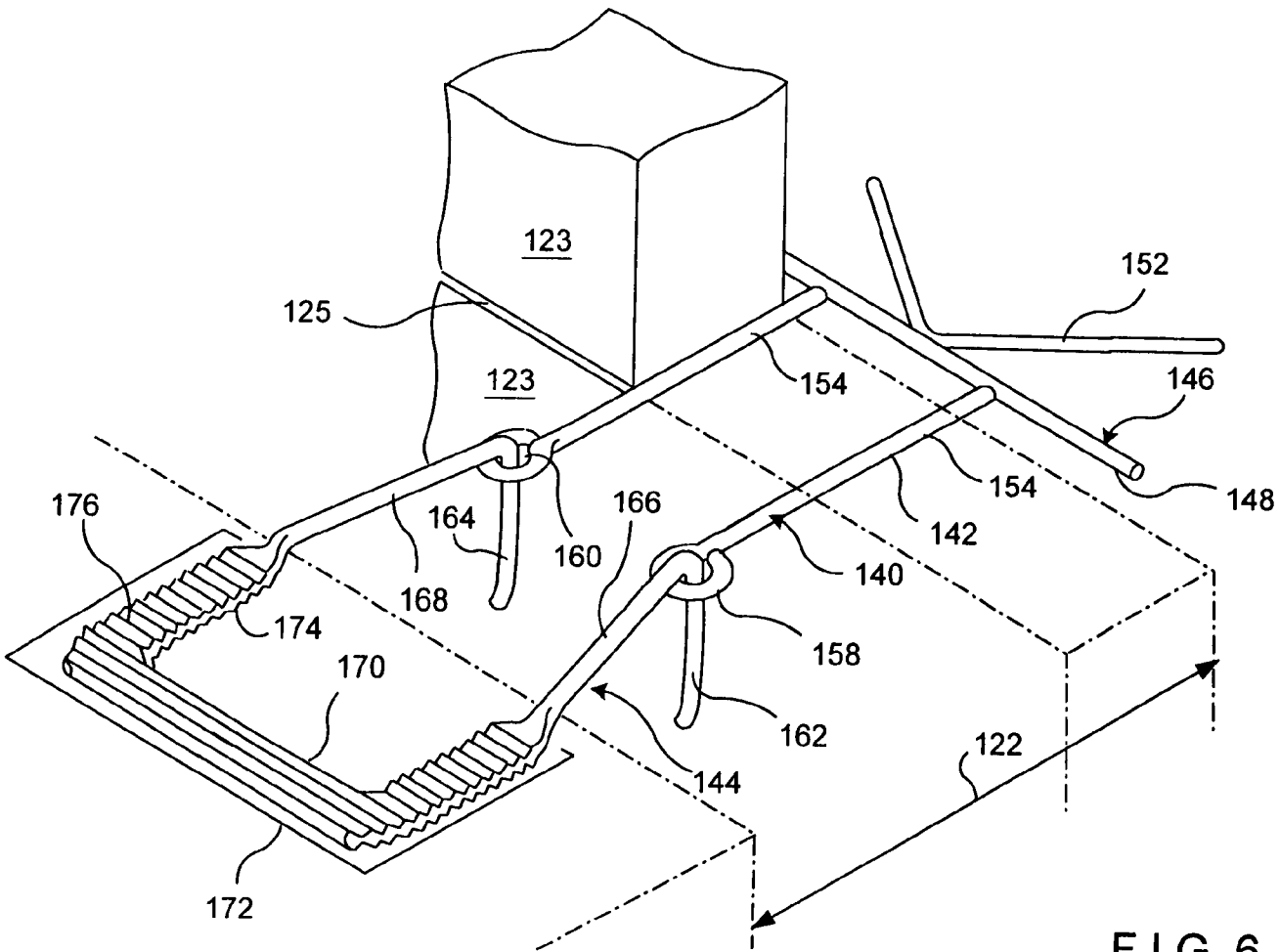
FIG. 6 is a partial perspective view of FIG. 5 showing a portion of the truss, a wall anchor and the interengaging veneer anchor.

The description which follows is of a second embodiment of the combined wall anchor and wall reinforcement device for masonry walls of this invention. For ease of comprehension, where similar parts are used reference designators "100" units higher are employed. Thus, the veneer anchor 144 of the second embodiment is analogous to the veneer anchor 44 of the first embodiment. Referring now to FIGS. 5 and 6, the second embodiment of this invention is shown and is referred to generally by the numeral 110. As in the first embodiment, a wall structure 112 is shown having an inner wythe or backup wall 114 of masonry blocks 116 and an outer wythe or a veneer 118 of facing bricks 120. Between the inner wythe 114 and the outer wythe 118, a cavity 122 is formed.

The cavity 122 is insulated with strips of insulation 123 attached to the exterior surface 124 of the inner wythe 114 and having seams 125 between adjacent strips coplanar with adjacent bed joints 126 and 128. The cavity 122 is as specified by architectural design and is normally in the 2-to-4-inch range. Successive bed joints 126 and 128 are formed between courses of blocks 116 and the joints are substantially planar and horizontally disposed. Also, successive bed joints 130 and 132 are formed between courses of bricks 120 and the joints are substantially planar and horizontally disposed. Selected bed joint 126 and bed joint 130 are constructed to be interconnected utilizing the construct hereof; however, the joints 126 and 130 are unaligned.

For purposes of discussion, the exterior surface 124 of the interior wythe 114 contains a horizontal line or x-axis 134 and an intersecting vertical line or y-axis 136. A horizontal line or z-axis 138, normal to the xy-plane, also passes through the coordinate origin formed by the intersecting x- and y-axes.

The wall anchor 140 is shown in FIG. 6 as having an insulation-spanning portion 142 for interconnection with veneer tie 144 and further is shown as being emplaced on a course of blocks 116 in preparation for embedment in the mortar of bed joint 126. In this embodiment, a truss-type wall reinforcement 146 is constructed of a wire formative with two parallel continuous straight side wire members 148 and 150 spaced so as, upon installation, to each be centered along the outer walls of the masonry blocks 116. An intermediate wire body 152 is interposed therebetween and connect wire members 148 and 150 separating and connecting side wires 148 and 150 reinforcement 146.

At intervals along the truss-type reinforcement 146, spaced pairs of transverse wire members 154 are attached by TOX fusion or fusion through the application of high pressure, to side wire 148. These pairs of wire members 154 extend into the cavity 122. Upon receiving the interconnecting portion of veneer anchor 144, the spacing between wire members 154 limits the x-axis movement of the construct. Each transverse wire member 154 has at the end opposite the attachment end an eye wire portion 158 formed from the transverse wire members. Similarly, a ladder-type reinforcement, as shown in FIG. 1, can be utilized with wire members 154.

When a ladder-type reinforcement is manufactured, the cross rods 52 and wire members 154 are manufactured from the same gauge wire formative and cut to the required lengths, resulting in a manufacturing process that reduces production time and costs.

Upon installation, the eyes 160 of eye wire portions 158 are constructed to be within a substantially horizontal plane normal to exterior surface 124. The eyes 160 are horizontally aligned to accept the pintles of a veneer anchor 144 threaded therethrough. The eyes 160 are slightly larger than the diameter of the pintles, which dimensional relationships minimize the movement of the construct in an xz-plane. For ensuring engagement, the pintles of veneer tie member 144 are constructed in a variety of lengths.

The low-profile veneer tie or wire formative anchor 144 is, when viewed from a top or bottom elevation, generally U-shaped. The low-profile wall tie 144 is dimensioned to be accommodated by a pair of eye wire portions 158 described, supra. The veneer anchor 144 has two rear leg portions or pintles 162 and 164, two substantially parallel side leg portions 166 and 168, which are substantially at right angles and attached to the rear leg portions 162 and 164, respectively, and a front leg portion 170. An insertion portion 172 of veneer anchor 144 is compressively reduced to a vertical height 174 and, upon installation, extends beyond the cavity 122 into bed joint 130, which portion includes front leg portion 170 and part of side leg portions 166 and 168. The longitudinal axes of side leg portions 166 and 168 and the longitudinal axis of the front leg portion 170 are substantially coplanar.

In the second embodiment, the above-described arrangement of wire formatives is readily adaptable for high-strength applications. This is accomplished by replacing standard 9-gauge (0.148-inch diameter) wall reinforcement wire with 3/16-inch (0.187-inch diameter) wire and, if additional strength is required, using a 0.250-inch wire is used to form the veneer anchor 144. In contradistinction to the first embodiment the insertion ends of wall anchor 140 is not compressively reduced in height. In this regard, veneer anchor 140 is reduced in height by 79%, to a height of 0.148-inch. Also and similar to the first embodiment, the successive insulation strips 123 when in an abutting relationship the one with the other are sufficiently resilient to seal at seam 125 without air leakage therebetween. The insulation-spanning portions 142 of wall anchor 140 are not flattened.

Upon compressing the insertion end of wall anchor 144, a corrugated pattern is optionally impressed thereon. The ridges and valleys of the corrugations 176 are shown in FIGS. 5 and 6 and are impressed so that, upon installation, the corrugations 176 are parallel to the x-axis 134.

The insertion portion 172 of veneer tie 144 is considerably compressed and, while maintaining the same mass of material per linear unit as the adjacent wire formative, the vertical height 174 is reduced. The vertical height 174 of insertion portion 172 is reduced so that, upon installation, mortar of bed joint 130 flows around the insertion portion 172. Upon compression, a pattern or corrugation 176 is impressed on either or both of the upper and lower surfaces of insertion portion 172. When the mortar of bed joint 130 flows around the insertion portion, the mortar flows into the valleys of the corrugations 176. The corrugations enhance the mounting strength of the veneer anchor 144 and resist force vectors along the z-axis 138. With veneer anchor 144 compressed as described, the veneer anchor retains substantially all the tensile strength as prior to compression.

The description which follows is of a third embodiment of the combined wall anchor and wall reinforcement device of this invention, which device is suitable for seismic applications. For ease of comprehension, where similar parts are used reference designators "200" units higher are employed. Thus, the wall anchor 240 of the third embodiment is analogous to the wall anchor 40 of the first embodiment. The veneer anchor of this embodiment is adapted from that shown in U.S. Pat. No. 5,454,200 to R. P. Hohmann.

Figure 7:
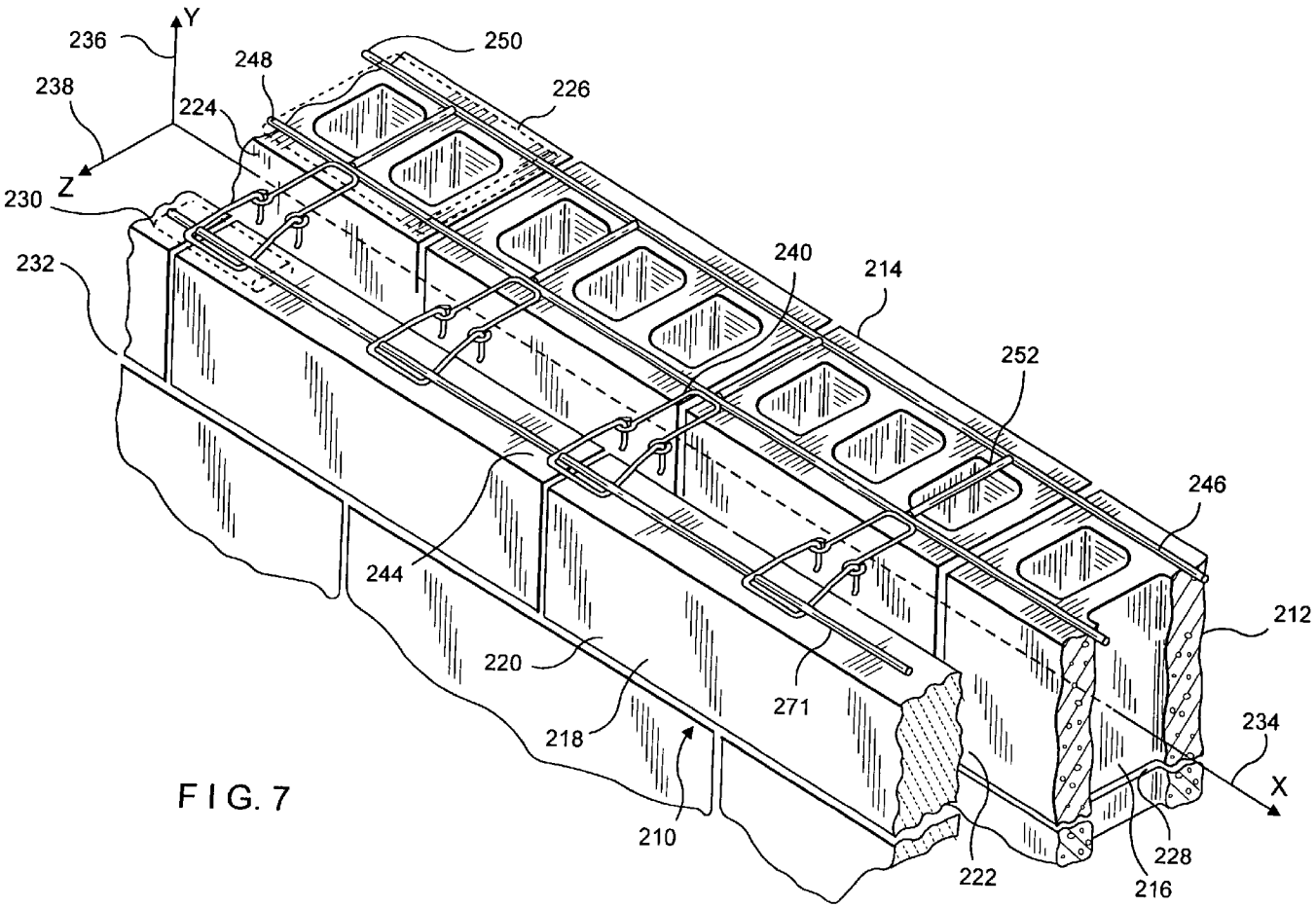
FIG. 7 is a perspective view of a third embodiment of this invention showing an anchor and reinforcement device for a masonry wall and is similar to FIG. 1, but is suitable for use in a seismic zone and shows a veneer anchor swaged to accept a continuous reinforcing wire for the stone veneer.
Figure 8:
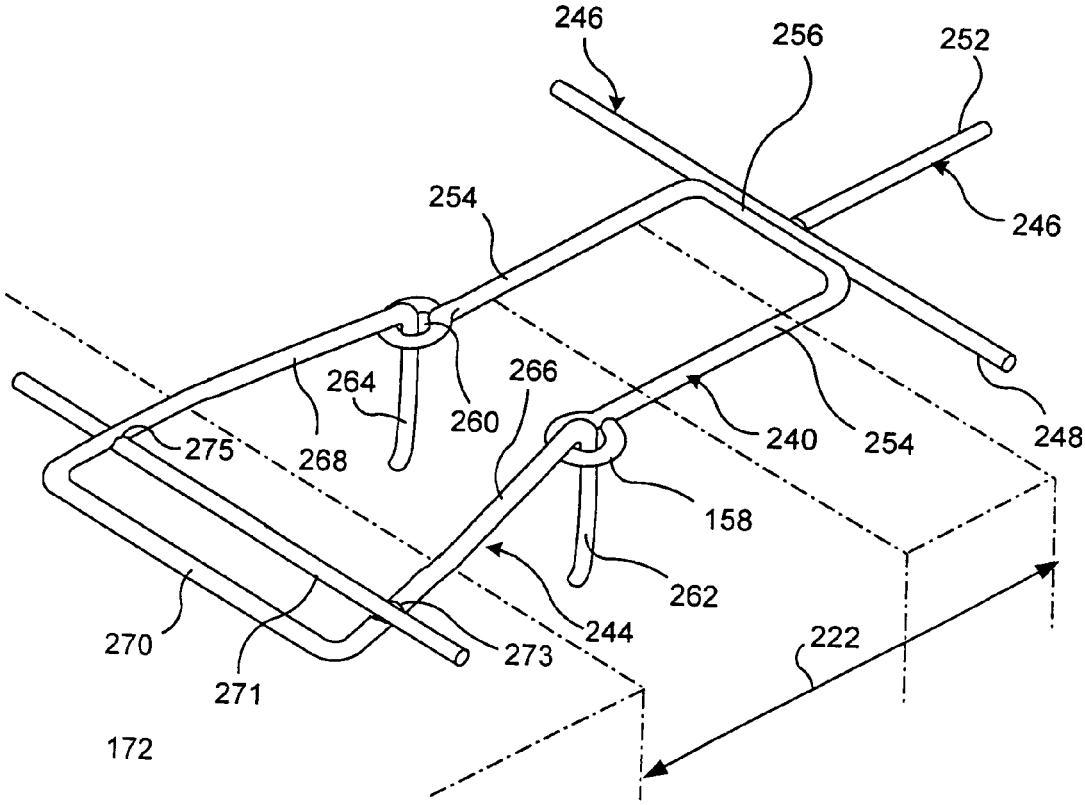
FIG. 8 is a partial perspective view of FIG. 7 showing details of a portion of the ladder-type reinforcement, the side-fused wall anchor, veneer anchor, and the veneer reinforcement.

Referring now to FIGS. 7 and 8, the third embodiment of a combined wall anchor and wall reinforcement device of this invention is shown and is referred to generally by the numeral 210. In this embodiment, a wall structure 212 is shown having an backup wall 214 of masonry blocks 216 and a facing wall or veneer 218 of facing stone 220. Between the backup wall 214 and the facing wall 218, a cavity 222 is formed, which cavity 222 extends outwardly from surface 224 of backup wall 214.

In the third embodiment, successive bed joints 226 and 228 are formed between courses of blocks 216 and the joints are substantially planar and horizontally disposed. Also, successive bed joints 230 and 232 are formed between courses of facing stone 220 and the joints are substantially planar and horizontally disposed. For each structure, the bed joints 226, 228, 230 and 232 are specified as to the height or thickness of the mortar layer and such thickness specification is rigorously adhered to so as to provide the uniformity inherent in quality construction. Selected bed joint 226 and bed joint 230 are constructed to align, that is to be substantially coplanar, the one with the other.

For purposes of discussion, the exterior surface 224 of the backup wall 214 contai a horizontal line or x-axis 234 and an intersecting vertical line or y-axis 236. A horizontal line or z-axis 238, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 210 includes a wall anchor 240 constructed for embedment in bed joint 226, which, in turn, includes a cavity-spanning portion 242. Further, the device 210 includes a low-profile, wire formative veneer tie or anchor 244 for embedment in bed joint 230. In order to meet seismic requirements, a veneer reinforcement, described infra., is included in anchoring system hereof.

The wall anchor 240 is shown in FIG. 7 as being emplaced on a course of blocks 216 in preparation for embedment in the mortar of bed joint 226. In the best mode of practicing this embodiment, a ladder-type wall reinforcement wire portion 246 is constructed of a wire formative with two parallel continuous straight wire members 248 and 250 spaced so as, upon installation, to each be centered along the outer walls of the masonry blocks 216. An intermediate wire bodies or cross rods 252 are interposed therebetween and connect wire members 248 and 250 forming rung-like portions of the ladder structure 246.

At intervals along the wall reinforcement 246, spaced pairs of transverse wire members 254 are attached thereto and are attached to each other by a rear leg 256 therebetween. These pairs of wire members 254 extend into cavity 222 to veneer anchor 244. As will become clear by the description which follows, the spacing between the transverse wire member 254 is constructed to limit the x-axis movement of the construct. Each transverse wire member 254 has at the end opposite the attachment end an eye wire portion 258 formed contiguous therewith.

Upon installation, the eye 260 of eye wire portion 258 is constructed to be within a substantially horizontal plane normal to exterior surface 224. The eye 260 is dimensioned to accept a pintle of the veneer anchor therethrough and has a slightly larger diameter than that of the anchor. This relationship minimizes the movement of the construct in an xy-plane. For positive engagement, the eye 260 of eye wire portion 258 is sealed forming a closed loop.

The veneer anchor 244 is, when viewed from a top or bottom elevation, generally U-shaped and is dimensioned to be accommodated by the pair of eye wires 258 previously described. The veneer anchor 244 has two rear leg portions or pintles 262 and 264, two parallel side leg portions 266 and 268, and a front leg portion 270, which have been compressively reduced in height. The front leg portion 270 accommodates veneer reinforcing wire member 271 which is threaded through swaged indentations 273 and 275.

As shown in FIG. 8, swaged indentation 273 is formed in the upper surface of side leg 266 so that, upon installation, the reinforcing wire 271 placed therein is embedded in bed joint 230. Also as shown in FIG. 8, swaged indentation 275 is formed in the lower surface of side leg 268 so that, upon installation, the reinforcing wire 271 placed therein is embedded in bed joint 230. Although the swaged indentations 273 and 275 are described as shown, the function of the veneer anchor 244 would be the same if the indentations were reversed. The longitudinal axes of leg portions 266, 268 and 270 are substantially coplanar. The pintles 262 and 264 are dimensioned to function cooperatively with the eyes 260 of eye wire portions 258 and thereby limits the movement of the construct in an xy-plane.

In this embodiment, indentations 273 and 275 are swaged into leg portions 266 and 268, respectively, which indentations are dimensioned to accommodate and cradle veneer reinforcing wire 271. With the veneer reinforcing wire 271 installed threadingly in veneer anchor 244 as described, the anchoring system meets building code requirements for seismic construction and the wall structure acquires the testing conditions therefor.

The above-described arrangement of wire formatives has been strengthened in several ways. First, in place of the standard 9-gauge (0.148-inch diameter) wall reinforcement wire, a 3/16-inch (0.187-inch diameter) wire is used throughout. Here, wall reinforcement 246, wall anchor 240, the veneer tie 244, and veneer reinforcing wire 271 are all formed from 0.187-inch diameter wire. The insertion end 272 of veneer tie 244 is reduced in height to 75% of original height to a height of 0.140-inch with the indentation 278 to a height of 0.110-inch. This enables the veneer reinforcing wire 271 to interlock with the veneer tie within the 0.300-inch tolerance. Although in this example compressive sizing is limited, the embodiment demonstrates the flexibility provided to architectural engineers by selectively compressing either or both the inner and outer wythe anchoring components.

An important aspect of the above-described wall reinforcement/wall anchor combinations is the flatness attainable for the overall assemblages. In this regard, viewing the unit as installed in a backup wall as shown in FIGS. 1, 5 and 7, it is seen that two xz-planes 0.187 inches apart would accommodate the anchor and reinforcement device while occupying only 50% of a standard 3/8-inch bed joint. Here taking the upper surface of a course of masonry blocks as coincident with the lower xz-plane, the plane would include the tangential contacts of the wire formatives of the reinforcement and of the wall anchors. In the embodiments in which insulation-spanning portions are compressed to minimize interference with the integrity of the insulation , it is noted that the portion of the unit resting on the masonry block is noncompressed. In the same size side-fused units the longitudinal axes of the wire components within the backup wall are coplanar.

Alternative to the preceding paragraph, the side-fused technique is applicable to wire formatives wherein the gauge of the reinforcement wire is different from that of the wall anchor component. Here, when the lower xz-plane is structured to include all the tangential contacts, the longitudinal axes of the wall reinforcement and the wall anchor would be in different planes.

In the manufacture of the disclosed anchor and reinforcement device, any of a number of metal joining techniques are available. The fusible attachment of the components is attainable using a variety of methods, including electric arc welding, spot welding, resistance welding and TOX fusion. Thus the components can also be joined by any method that causes the wire formative to be liquified and connected together.

It is noted that the various components of the above embodiments are interchangeable in a mix-and-match fashion. Thus, any of the three styles of wall anchors—namely, the U-shaped, vertical eye anchor; the two-armed horizontal eye anchor; and, the U-shaped, horizontal eye anchor—are available with either a ladder-type or a truss-type wall reinforcement. Additionally, any of the wall anchor arms extending through seams of insulation can be compressed to minimize openings required therefor and to maintain insulation integrity. The corresponding veneer ties can similarly be selected to accommodate a reinforcement wire formative in the facing wall or can be selected for special applications such as nonstandard bed joints (common in restoration work).

In making the combination anchor and reinforcement device, wire-formative manufacturing processes have been developed which are best described in various method steps. These steps include the steps of:

(1) forming a wall reinforcement adapted for disposition in a bed joint of a backup wall, which step, in turn, includes the substeps of:

(a) placing a pair of side wires parallel to one another; (b) attaching one or more intermediate wires to the interior sides of said side wires for maintaining the parallelism thereof in a truss or ladder configuration;

(2) fusibly attaching at least one wall anchor at one end thereof to the wall reinforcement at the side opposite the interior side of the intermediate wire attachment. As seen in the drawings of the various embodiments, the wall anchor is adapted, upon installation, to have the attached end thereof extend into the bed joint and to have one or more leg portions extend into the cavity; and, (3) providing a free end contiguous with leg portions of the wall anchor, the free end for disposition in the cavity and adapted to interengage a veneer anchor for embedment in a bed joint of the facing wall.

Referring to FIGS. 1 through 4, 7, and 8, embodiments are shown wherein the wall anchor is a wire formative having two legs extending into the cavity, with the legs connected to one another by a rear leg. Thus, the method includes the step of fusibly attaching the wall anchor to the wall reinforcement along the exterior side of the side wire thereof and along the length of the rear leg. Although these embodiments show welds along the entire length, the joining of the rear leg of the wall anchor to the exterior of the side wire of the wall reinforcement by one or more spot welds is within the contemplation of this invention.

Referring to FIGS. 2, 3, 4, 6, and 8 embodiments are shown wherein the wires forming the wall reinforcement and forming the wall anchor are the same gauge. In fusibly attaching the wall anchor to the wall reinforcement care is taken to form a construct wherein the longitudinal axes of the side wires of the wall reinforcement of the legs of the wall anchor including the rear leg thereof are coplanar. When the combination wall reinforcement and wall anchor is formed in this manner, the flatness is not only advantageous for material handling, but further ensures good coverage by the mortar of the bed joint. As the components—the wall reinforcement and the wall anchor—are coplanar thicker gauge wire can be used in the structure without interfering with the bed joint height limitations.

With the side-fused structures, the method of making the combination wall reinforcement and wall anchor also includes devices formed with different gauges of wire. Here, the ladder- or truss-type reinforcement and the wall anchor are optionally formed with the tangential contacts being coplanar rather than the longitudinal axes.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An anchor and reinforcement device for use in a wall having a backup wall and a facing wall in a spaced apart relationship having a cavity therebetween, said backup wall formed from successive courses of masonry block with a bed joint of predetermined height between each two adjacent courses and, further, each course of masonry block having an embedment surface lying in a substantially horizontal plane, said anchor and reinforcement device comprising, in combination:

a wall reinforcement adapted for disposition upon one of said courses of masonry blocks and for embedment in said bed joint of said backup wall, said wall reinforcement adapted for disposition in said embedment surface, in turn, comprising;

a pair of side wires disposed parallel to one another;

one or more intermediate wires attached to the interior sides of said side wires maintaining the parallelism thereof in a truss or ladder configuration having, when disposed on said embedment surface, all the longitudinal axes of said side wires and said intermediate wires in a substantially horizontal plane;

at least one wire-formative wall anchor attached at one end thereof to said wall reinforcement at the side opposite said interior side of said intermediate wire attachment, and, upon installation, adapted to extend into said cavity, said wall anchor comprising:

two leg portions extending into said cavity, said two leg portions attached by non-welding fusible attachment to said side wire at a substantially 90 degree angle with the longitudinal axes of said side wires and said two leg portions being substantially coplanar, said fusible attachment through high pressure compression liquefying the surfaces of said two leg portions and said side wires and being conjoined upon solidification thereof; and, a free end contiguous therewith, said free end disposed in said cavity and adapted to interengage a veneer anchor for embedment in said bed joint of said facing wall.

2. An anchor and reinforcement device as described in claim 1, wherein said wall anchor further comprises a rear leg connecting said leg portions extending into said cavity, said rear leg fusibly attached to said side wire at a substantially 90 degree angle wherein the longitudinal axes of said side wires and said two legs are substantially coplanar.

3. An anchor and reinforcement device as described in claim 2, wherein said rear leg is fusibly attached through high pressure compression, wherein said high pressure causes the surfaces of said wire formatives and said side wire to liquify and upon solidification conjoin.

4. An anchor and reinforcement device as described in claim 1, wherein said free end further comprises one or more veneer anchor receptors of vertically disposed eye wires.

5. An anchor and reinforcement device as described in claim 1, wherein said free end further comprises one or more veneer anchor receptors of horizontally disposed eye wires.

6. An anchor and reinforcement device as described in claim 1, wherein said free end further comprises one or more veneer anchor receptor of vertically disposed eye wires formed from said free end.

7. An anchor and reinforcement device as described in claim 1, wherein said free end further comprises one more veneer anchor receptors of horizontally disposed eye wires formed from said free end.

8. An anchor and reinforcement device as described in claim 1, wherein said backup wall further has an insulative layer mounted thereon in said cavity, said insulative layer being spanned by extension portion of said legs of said wall anchor.

9. An anchor and reinforcement device as described in claim 8, wherein said extension portions are compressively reduced in height up to 75% of the original height thereof.

10. An anchor and reinforcement device as described in claim 8, wherein said insulative layer further comprises a plurality of insulative strips mounted sealingly one against the other having a seam between adjacent ones of said strips, said seams being substantially coplanar with corresponding said bed joint of said backup wall and wherein said extension portions of said legs of said wall anchor are adapted, upon said wall anchor being embedded in said bed joint of said backup wall, to extend across said insulative layer at said seam between adjacent ones of said insulative strips and to have said insulative strips sealingly surround said extension portions of said legs of said wall anchor.

11. A method of making an anchor and reinforcement device for use in a wall formed from a backup wall and a facing wall in a spaced apart relationship having a cavity therebetween, said side-welded anchor and reinforcement device comprising, in combination:

forming a wall reinforcement adapted for disposition in a bed joint of said backup wall, said wall reinforcement being a wire formative, in turn, by the substeps of placing a pair of side wires parallel to one another;

attaching one or more intermediate wires to the interior sides of said side wires for maintaining the parallelism thereof in a truss or ladder configuration;

fusibly attaching through non-frictional high pressure fusion at least one wall anchor at one end thereof to said wall reinforcement at the side opposite said interior side of said intermediate wire attachment, said wall anchor adapted, upon installation, to extend into said bed joint and to have one or more leg portions extend into said cavity; and, providing a free end contiguous with said one or more leg portions, said free end for disposition in said cavity and adapted to interengage a veneer anchor for embedment in a bed joint of said facing wall.

12. A method of claim 11, wherein said wall anchor is a wire formative having two legs extending into said cavity, with said legs connected to one another by a rear leg further including the step of fusibly attaching said wall anchor to said wall reinforcement at said exterior side of said side wire thereof and along the length of said rear leg.

13. A method of claim 11, wherein the wires forming said wall reinforcement and forming said wall anchor are the same gauge and wherein the step of fusibly attaching said wall anchor to said wall reinforcement forms a construct, with the longitudinal axes of said side wires of said wall reinforcement of said legs extending into said cavity, and of said rear leg being coplanar.

14. A method of claim 11, wherein the wire forming said wall reinforcement and forming said wall anchor are different gauges and wherein the step of fusibly attaching said wall reinforcement to said wall anchor maintains the tangential contacts thereof with said bed joint of said backup wall substantially coplanar.

15. A method of anchoring a facing wall to a backup wall, said backup wall and said facing wall in a spaced apart relationship having a cavity therebetween, said method comprising the steps of:

embedding a combined anchor and wall reinforcement device in bed joints of said backup wall, said device being a wire formative made by the substeps of:

placing a pair of side wires parallel to one another;

attaching one or more intermediate wires to the interior sides of said side wires for maintaining the parallelism thereof in a truss or ladder configuration;

fusibly attaching, through non-welding high pressure fusion, at least one wall anchor at one end thereof to said wall reinforcement at the side opposite said interior side of said intermediate wire attachment, said wall anchor adapted, upon installation, to extend into said bed joint and to have one or more leg portions extend into said cavity;

providing a free end contiguous with said one or more leg portions, said free end sposed in said cavity having one or more veneer anchor receptors;

interengaging a veneer anchor with said receptors and disposing said veneer anchor in a bed joint of said facing wall; and, embedding said veneer anchor in said bed joint of said facing wall.

16. A method of claim 15, wherein said backup wall includes insulation mounted thereon in said cavity and said substeps for forming said anchor and wall reinforcement device including the substep of:

compressing the portion of said device extending when installed through said insulation to maintain the insulative integrity thereof.

17. A method of claim 15, wherein said wall reinforcement and said wall anchor are of the same gauge of wire, said embedment step, including the substep of maintaining, during installation, said wire components in a substantially coplanar manner.

18. An anchor and reinforcement device for use in a wall having a backup wall and a facing wall in a spaced apart relationship having a cavity therebetween, said backup wall formed from successive courses of masonry block with a bed joint of predetermined height between each two adjacent courses and, further, each course of masonry block having an embedment surface lying in a substantially coplanar manner, said anchor and reinforcement device comprising, in combination:

a wall reinforcement adapted for disposition upon one of said courses of masonry blocks and for embedment in said bed joint of said backup wall, said wall reinforcement adapted for disposition in said embedment surface comprising;

a pair of side wires disposed parallel to one another;

one or more intermediate wires attached to the interior sides of said side wires maintaining the parallelism thereof in a truss or ladder configuration having the upper limits of said pair of side wires disposed in a first plane and the lower limits of said pair of side wires disposed in a second plane, said first plane and said second plane being parallel the one to the other and forming an envelope therebetween;

at least one wall anchor fusibly attached at one end thereof to said wall reinforcement in said envelope and at the side opposite said interior side of said intermediate wire attachment through non-frictional high pressure compression wherein said high pressure compression causes the surfaces of said wall anchor and said wall reinforcement to liquefy and upon solidification conjoin; and, said wall anchor, upon installation adapted to extend into said cavity, said wall anchor comprising, in turn:

one or more leg portions extending into said cavity; and, a free end contiguous therewith, said free end disposed in said cavity and adapted to interengage a veneer anchor for embedment in said bed joint of said facing wall.

19. A method of making an anchor and reinforcement device for use in a wall formed from a backup wall and a facing wall in a spaced apart relationship having a cavity therebetween, said side-welded anchor and reinforcement device comprising, in combination:

forming a wall reinforcement adapted for disposition in a bed joint of said backup wall, said wall reinforcement being a wire formative, in turn, by the substeps of placing a pair of side wires parallel to one another;

attaching one or more intermediate wires to the interior sides of said side wires for maintaining the parallelism thereof in a truss or ladder configuration having the upper limits of said pair of side wires disposed in a first plane and the lower limits of said pair of side wires disposed in a second plane, said first plane and said second plane being parallel the one to the other and forming an envelope therebetween;

fusibly attaching at least one wall anchor through non-frictional high pressure compression at one end thereof to said wall reinforcement in said envelope and at the side opposite said interior side of said intermediate wire attachment, said wall anchor adapted, upon installation, to extend into said bed joint and to have one or more leg portions extend into said cavity; and, providing a free end contiguous with said one or more leg portions, said free end for disposition in said cavity and adapted to interengage a veneer anchor for embedding in a bed joint of said facing wall.

* * * * *